United States Patent [19]

Bussjager

[11] 4,347,708

[45] Sep. 7, 1982

[54] MAKEUP AIR PRECONDITIONER FOR USE WITH AN AIR CONDITIONING UNIT

[75] Inventor: Rudy C. Bussjager, Syracuse, N.Y.

[73] Assignee: Carrier Corporation, Syracuse, N.Y.

[21] Appl. No.: 235,888

[22] Filed: Feb. 19, 1981

Related U.S. Application Data

[62] Division of Ser. No. 89,658, Oct. 30, 1979, Pat. No. 4,281,522.

[51] Int. Cl.[3] ..... F25D 17/06

[52] U.S. Cl. ..... 62/95; 62/DIG. 16; 165/16; 165/30

[58] Field of Search ..... 62/409, 263, DIG. 16, 62/95; 165/16, 30

[56] References Cited

U.S. PATENT DOCUMENTS

| | | | |
|---|---|---|---|
| 2,338,382 | 1/1944 | Marlow | 165/30 |
| 2,755,072 | 7/1956 | Kreuttner | 165/59 |
| 3,185,209 | 5/1965 | Quick | 165/30 |
| 4,139,052 | 2/1979 | Lackey | 62/DIG. 16 |
| 4,142,525 | 3/1979 | Glancey | 165/16 |
| 4,157,112 | 6/1979 | Swiderski | 165/16 |
| 4,266,599 | 5/1981 | Saunders et al. | 165/16 |

*Primary Examiner*—Ronald C. Capossela

*Attorney, Agent, or Firm*—J. Raymond Curtin; Robert P. Hayter

[57] ABSTRACT

Apparatus and method for preconditioning makeup air supplied to an air conditioning unit. An add-on preconditioning unit having a separate vapor compression refrigeration circuit is disclosed for heating or cooling makeup air supplied to an air conditioning system.

3 Claims, 2 Drawing Figures

MAKEUP AIR PRECONDITIONER FOR USE WITH AN AIR CONDITIONING UNIT

This application is a division of application Ser. No. 089,658, filed Oct. 30, 1979, now U.S. Pat. No. 4,281,522.

BACKGROUND OF THE INVENTION

1. Field of the Invention

The present invention relates to an air conditioning system. More particularly, the present invention concerns pretreating makeup air being supplied to an air conditioning unit.

2. Description of the Prior Art

In a typical air conditioning system having a vapor compression refrigeration circuit various components such as a compressor, condenser, evaporator and expansion device are arranged to transfer heat energy between a fluid in heat transfer relation with the evaporator and a fluid in heat transfer relation with the condenser. In a heat pump system an outdoor coil and an indoor coil are located such that the compressor through a reversing valve may direct hot gaseous refrigerant to either coil acting as a condenser. The other coil then acts as an evaporator such that, depending upon the position of the reversing valve, heat energy is either rejected or absorbed in both the indoor coil or the outdoor coil. In the heating mode of operation, heat is rejected in the indoor coil acting as a condenser and heat is absorbed at the outdoor coil acting as an evaporator. The reverse is true in the cooling mode of operation wherein the heat is rejected in the outdoor coil acting as a condenser and heat is absorbed in the indoor coil acting as an evaporator.

It is known in the air conditioning industry to provide an air conditioning unit which is suitable for being mounted on the roof or by the side or some other location next to an enclosure to be conditioned. This unit is typically divided into an indoor section having an indoor heat exchanger and an outdoor section having an outdoor heat exchanger. An indoor fan is mounted within the indoor section for supplying conditioned air to the enclosure. This indoor fan draws this air both from the enclosure as return air and from ambient air as makeup air. The air entering the indoor section is passed in heat exchange relation with the indoor heat exchanger wherein either the heat is absorbed from the air flowing therethrough or heat is rejected to said air. Consequently, the air being supplied to the enclosure is conditioned within the indoor section of the air conditioning unit.

The outdoor section of the unit is arranged such that heat energy may be transferred between the outdoor heat exchanger and the ambient air flowing therethrough. Typically, an outdoor fan is provided to circulate the air through the outdoor heat exchanger. The compressors of the typical system are located within the outdoor section.

Under some operating conditions a relatively high amount of makeup air is required. Particularly in fast food operations having a large grease utilization within the enclosure makeup air may amount to as much as 50% of the supply air to the enclosure. With a high percentage of makeup air required and when the ambient conditions are extreme, it has been found helpful to precondition the makeup air. Makeup air is preconditioned to achieve several effects. Firstly, the capacity of the air conditioning unit (not including preconditioning unit) may be decreased if the makeup air being supplied thereto is preconditioned to either raise or lower its temperature. This sizing decrease may result in a cost reduction in the manufacture of the unit. Additionally, by preconditioning makeup air the air conditioning unit whether in the cooling mode or the heating mode is more efficient since the makeup air has already had its temperature raised or lowered depending upon the appropriate conditions. Consequently, by preconditioning makeup air there may not only be initial savings in manufacturing costs but by an increase in efficiency there may be additional savings in the operating cost of the air conditioning unit.

Additionally, depending upon the various controls, it may be possible under some ambient conditions to provide complete conditioning of the air with the preconditioning unit. As described herein, the preconditioning unit will have a separate heat pump system for transferring heat energy between the makeup air and the ambient. Under certain conditions this makeup air heat pump may be sufficient to handle the load on the system.

SUMMARY OF THE INVENTION

It is an object of the present invention to provide an air conditioning system which receives both return air and makeup air.

It is a further object of the present invention to provide an add-on preconditioning unit for raising or lowering the temperature of makeup air supplied to the air conditioning unit.

It is another object of the present invention to provide a safe, economical and reliable add-on unit capable of increasing the energy efficiency of an air conditioning unit.

These and other objects of the present invention are achieved with the addition of the preconditioning unit to an air conditioning system. The preconditioning unit is mounted such that makeup air flows through a makeup air flow path into the indoor section of the air conditioning unit wherein it is treated and discharged to the enclosure. The preconditioning unit has a partition dividing the unit into a makeup air section and an ambient section. The flow of makeup air into the makeup air section is regulated by a damper arrangement, said flow passing first through the dampers and then through the makeup air heat exchanger prior to be conducted into the indoor section of the air conditioning system. The ambient heat exchanger and compressor are connected to the makeup air heat exchanger to form a refrigeration circuit such that heat energy may be transferred between the makeup air and the ambient air.

DESCRIPTION OF THE PREFERRED EMBODIMENT

The invention as described herein will refer to a rooftop type air conditioning unit adapted to receive return air from the bottom of the unit and to likewise discharge supply air through the bottom of the unit. This invention finds like applicability in all types of air conditioning systems which require makeup air. Additionally, this invention would also apply to other types of refrigeration systems wherein preconditioning the air might be effective to increase the overall performance of the system. Although the present preconditioning unit is described having a separate vapor compression refrigeration circuit utilizing a heat pump it is to be understood that the preconditioning unit might have a nonreversible refrigeration circuit or might have alternate heating means located in the makeup air flow path.

Figure 1:
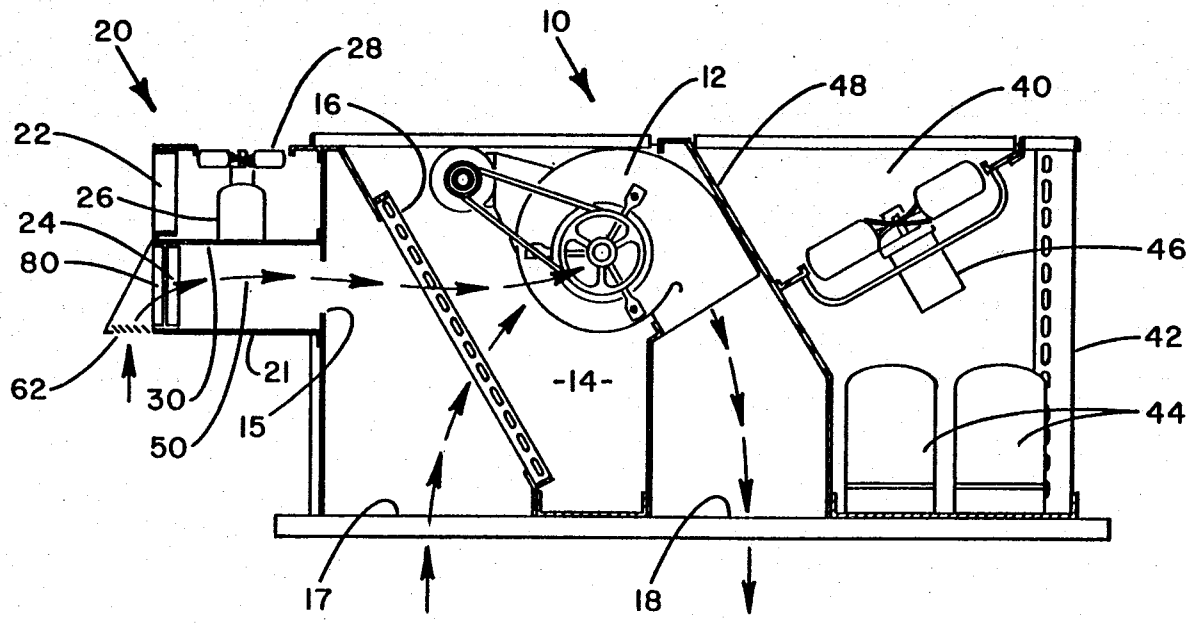
FIG. 1 is a schematic view of a rooftop type air conditioning unit having an add-on preconditioning unit.

Referring now to FIG. 1 there can be seen a rooftop type air conditioning unit 10. The unit is divided by divider 48 into an indoor section 14 and an outdoor section 40. Within the outdoor section are mounted outdoor heat exchanger 42, compressors 44 and outdoor fan 46. The outdoor fan serves to circulate ambient through the outdoor heat exchanger 42 to effect heat exchange therebetween. Indoor section 14 has indoor heat exchanger 16 and indoor fan 12 mounted therein. Return air opening 17 is provided at the bottom of the indoor section as is supply air opening 18. Indoor fan 12 acts to draw air through indoor heat exchanger 16 and discharge same downwardly through the supply air opening 18 into the enclosure to be conditioned.

Preconditioning unit 20 is shown mounted to the end of the air conditioning unit such that makeup air flow path 50 is located in registration with makeup air opening 15 of the indoor section of the air conditioning unit. The preconditioning unit has casing 21 forming an enclosure, said enclosure being divided by partition 30 into an ambient air section and a makeup air section. Dampers 62 regulate the flow of makeup air into the makeup air flow path. Makeup air heat exchanger 24 is located in the makeup air flow path and heaters 80 are located between dampers 62 and heat exchanger 24. Ambient heat exchanger 22 and compressor 26 as well as fan 28 are all located within the ambient section 60 of the preconditioning unit.

Figure 2:
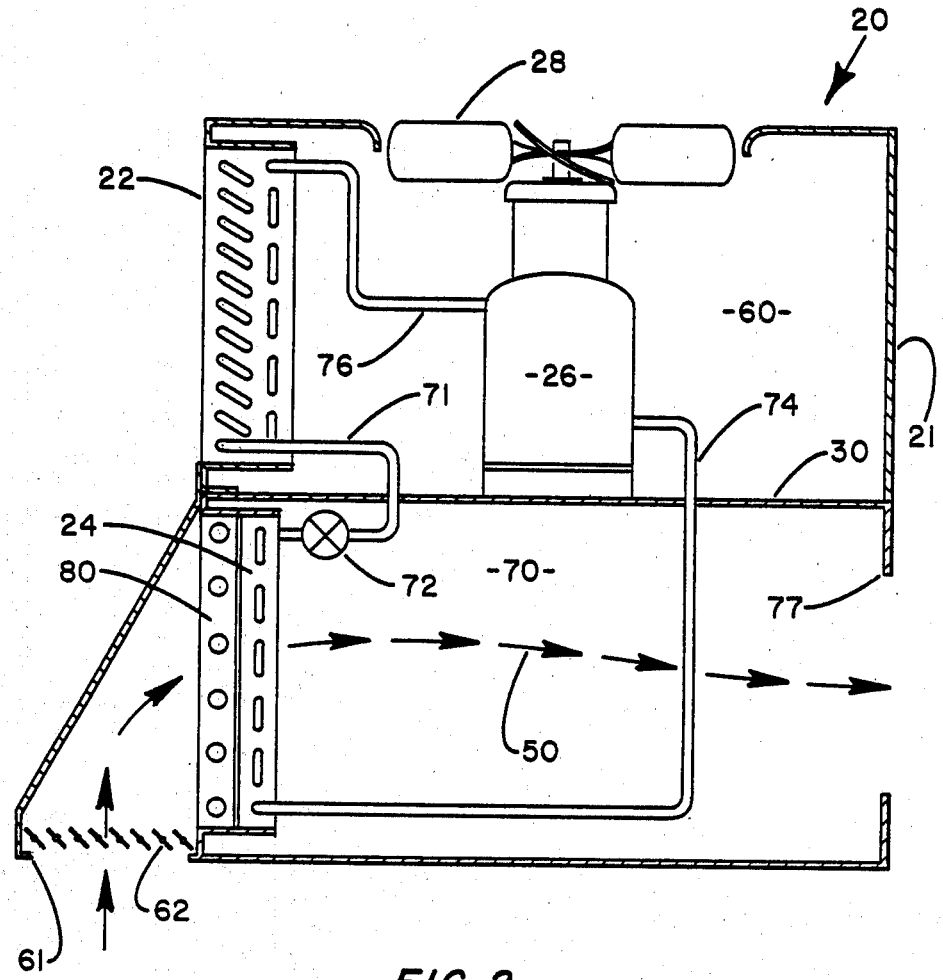
FIG. 2 is a schematic view of the preconditioning unit to be added on to an air conditioning system.

FIG. 2 is an enlarged schematic view of preconditioning unit 20 and more clearly indicates the relation of damper 62, heaters 80 and makeup air heat exchanger 24. It can be further seen in FIG. 2 that compressor 26 is connected by conduit 76 to ambient heat exchanger 22. Ambient heat exchanger 22 is connected by conduit 71 to expansion device 72 which is connected to makeup air heat exchanger 24. Conduit 74 then connects makeup air heat exchanger 24 to compressor 26. This system for illustration purposes only is shown as a straight air conditioning system. Provision of a four-way valve or other means may likewise provide for this refrigeration circuit to be a heat pump circuit capable of supplying heating or cooling to the makeup air heat exchanger 24.

The makeup air flow path can be seen starting at makeup air inlet opening 61 regulated by dampers 62. The makeup air then flows through electric resistance heaters 80, through makeup air heat exchanger 24, through the makeup air section 70 to makeup air discharge outlet 77 which is in registration with the makeup air opening 15 of the indoor section of the air conditioning unit.

Electric heaters 80 may be energized to supply heat for defrosting ice accumulation on the ambient air heat exchanger as well as heating the makeup air. If the makeup air heat exchanger is used as the condenser of a heat pump to reject heat to the makeup air ice may under appropriate ambient conditions form on the ambient air heat exchanger. Defrost of the ambient air heat exchanger is provided by reversing the refrigeration circuit such that the makeup air heat exchanger absorbs heat energy. By providing the electric resistance heaters the energy absorbed may come from the heaters and the makeup air may additionally be heated. Without the heaters heat energy would be absorbed from the makeup air such that the temperature of the makeup air would be lowered when it is desirable to raise the temperature of the makeup air.

OPERATION

Under design operating conditions without a preconditioning unit the air conditioning system would have to be of sufficient size to meet both the heating and cooling loads. By providing a preconditioning unit it is possible to reduce the overall heating and cooling capacity of the air conditioning unit since the makeup air being supplied thereto has been preconditioned.

When the enclosure or space has a cooling or heating demand the air conditioning system is operated to supply treated air to the space. When ambient conditions are appropriate, the makeup air being supplied through the preconditioning unit is heated or cooled by makeup air heat exchanger 24. Typically, on a very cold or very hot day the entering temperature of the makeup air may be raised or lowered such that the overall temperature condition of the combination of return air and makeup air entering the indoor heat exchanger is raised or lowered such that the refrigeration circuit of the air conditioning unit is operating in a much more efficient range.

Either the refrigeration circuit of the air conditioning unit which may be a straight air conditioning system or a heat pump is operated alone, the preconditioning unit is operated alone or both systems are operated simultaneously. The provision of two separate systems provides the added flexibility of operating the systems independently or together and the cost reduction of being able to size the units based on the combined operation. Additionally, the provision of a combined operation allows for more efficient performance of the units. The operation of the preconditioning unit solely may additionally save energy under some load conditions.

While the invention has been described in reference to a preferred embodiment it is to be understood by those skilled in the art that modifications and variations can be effected within the spirit and scope of the invention. It is further to be understood that although the preferred embodiment is described having a straight air conditioning system in combination with a heat pump it is within the spirit and scope of the invention to utilize any type of refrigeration circuit in either the air conditioning unit or the preconditioning unit.

I claim:

1. A method of operating an air conditioning unit including a vapor compression refrigeration circuit, said unit being adapted to be connected to the return and supply ducts of an enclosure for supplying conditioned air to the enclosure which comprises the steps of:

circulating air from the enclosure through the return duct to an indoor portion of the air conditioning unit and back from the air conditioning unit to the enclosure through the supply duct;

selectively operating the vapor compression refrigeration circuit to either heat, cool or pass without temperature change the air passing through the unit from the step of circulating;

introducing ambient air into the indoor portion of the air conditioning unit to mix with the flow of air from the step of circulating;

regulating the volume of ambient air flow introduced into the circulating air path at the indoor portion of the unit;

providing a second vapor compression refrigeration circuit in heat exchange relation with ambient air and the air being introduced into the indoor portion of the unit; and appropriately energizing the second refrigeration circuit thereby controlling the temperature of the ambient air introduced into the circulating air flow path.

2. The method as set forth in claim 1 wherein the step of regulating includes adjusting a damper to vary the area of the intake through which ambient air enters the apparatus.

3. The method as set forth in claim 1 wherein the step of circulating includes:

energizing a fan which supplies air to the enclosure and which receives return air from the enclosure and makeup air from the step of introducing air into the flow path.

* * * * *